US012202689B2

(12) United States Patent
Kurosaki

(10) Patent No.: US 12,202,689 B2
(45) Date of Patent: Jan. 21, 2025

(54) METHOD FOR PRODUCING CORELESS ROLL PAPER

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 348 days.

(21) Appl. No.: 17/773,150

(22) PCT Filed: Dec. 28, 2020

(86) PCT No.: PCT/JP2020/049087
§ 371 (c)(1),
(2) Date: Apr. 29, 2022

(87) PCT Pub. No.: WO2022/144951
PCT Pub. Date: Jul. 7, 2022

(65) Prior Publication Data

US 2023/0159292 A1 May 25, 2023

(51) Int. Cl.
*B65H 19/22* (2006.01)
*B65H 19/28* (2006.01)
*B65H 19/30* (2006.01)

(52) U.S. Cl.
CPC ..... *B65H 19/2276* (2013.01); *B65H 19/2292* (2013.01); *B65H 19/286* (2013.01); *B65H 19/30* (2013.01); *B65H 2301/41429* (2013.01); *B65H 2301/41852* (2013.01); *B65H 2404/52131* (2013.01)

(58) Field of Classification Search
CPC ..... B65H 19/2292; B65H 19/286; B65H 2701/18422; B65H 2701/1844; B65H 2301/41432; B65H 2301/41428; B65H 2404/52131; B65H 2301/41429
See application file for complete search history.

(56) References Cited

U.S. PATENT DOCUMENTS 4,487,378 A * 12/1984 Kobayashi ..... A47K 10/32 242/613.2
4,763,785 A * 8/1988 Bradley ..... B65H 75/18 242/178
5,518,200 A 5/1996 Kaji et al.
(Continued)

FOREIGN PATENT DOCUMENTS

CA 2712492 A1 * 9/2009 ..... A47K 10/16
CN 1100062 A 3/1995
(Continued)

OTHER PUBLICATIONS

Extended European Search Report dated Oct. 28, 2022 from the European Patent Office in EP Application No. 20957908.5.

*Primary Examiner* — William A. Rivera
(74) *Attorney, Agent, or Firm* — Sughrue Mion, PLLC

(57) ABSTRACT

A method for producing coreless roll paper includes a winding step in which paper 11 is wound on a shaft 20 in a roll shape, and an extracting step in which the shaft 20 is extracted from roll paper 12 to form a center hole 13. The shaft 20 includes a body part 22 having grooves 23, and a sleeve 30 is put on and fixed to the body part 22. In the winding step, the paper 11 is wound on the sleeve 30.

14 Claims, 10 Drawing Sheets

(56) References Cited

U.S. PATENT DOCUMENTS

| | | | | | |
|---|---|---|---|---|---|
| 5,620,148 | A * | 4/1997 | Mitchell | ..... | B65H 18/28 242/160.4 |
| 5,722,608 | A | 3/1998 | Yamazaki | | |
| 5,730,387 | A * | 3/1998 | Yamazaki | ..... | B65H 19/28 242/537 |
| 2003/0132330 | A1 | 7/2003 | Kubota et al. | | |
| 2014/0084102 | A1 | 3/2014 | Techlin | | |
| 2016/0214820 | A1 | 7/2016 | Techlin | | |
| 2018/0282097 | A1 | 10/2018 | Techlin | | |
| 2020/0062530 | A1 | 2/2020 | Kurosaki | | |
| 2020/0156891 | A1* | 5/2020 | Kurosaki | ..... | B65H 18/28 |
| 2021/0380362 | A1 | 12/2021 | Sundermann et al. | | |

FOREIGN PATENT DOCUMENTS

| | | | | | |
|---|---|---|---|---|---|
| CN | 108934159 | B * | 11/2020 | ..... | A47K 10/16 |
| CN | 110505825 | B | 7/2021 | | |
| EP | 0 589 481 | A1 | 3/1994 | | |
| EP | 3 632 280 | A1 | 4/2020 | | |
| JP | 58-200719 | A | 11/1983 | | |
| JP | 6-156821 | A | 6/1994 | | |
| JP | 06156825 | A * | 6/1994 | ..... | B65H 18/10 |
| JP | 7-81808 | A | 3/1995 | | |
| JP | H10212070 | A * | 8/1998 | ..... | B65H 55/04 |
| JP | 4103960 | B2 | 6/2008 | | |
| JP | 2014-226280 | A | 12/2014 | | |
| JP | 2016-131761 | A | 7/2016 | | |
| JP | 2018-139723 | A | 9/2018 | | |
| WO | 93/21094 | A1 | 10/1993 | | |
| WO | 2019/224370 | A1 | 11/2019 | | |

* cited by examiner

METHOD FOR PRODUCING CORELESS ROLL PAPER

CROSS REFERENCE TO RELATED APPLICATIONS

This application is a National Stage of International Application No. PCT/JP2020/049087 filed Dec. 28, 2020.

TECHNICAL FIELD

The present disclosure relates to a method for producing coreless roll paper.

BACKGROUND ART

Roll paper, such as typical toilet paper, includes a core made of tubular cardboard, and a tissue material (paper) is wound around the core to form a roll shape. Hence, after the roll paper is used up, the core needs to be discarded. To eliminate the need of discarding the core, various coreless roll paper has been produced.

In a proposed method for producing such coreless roll paper, for example, a winding-start end of a tissue material is folded back, moisture is added to the folded back portion, and the tissue material is wound on a winding shaft (shaft) (see Patent Literature 1).

With this production method, by adhering and solidifying a plurality of layers of the tissue material near the winding shaft with the moisture, a hollow, cylindrical inner solidified layer can be formed on the winding shaft side, that is, on the center side of the roll paper. This inner solidified layer serves as a core and can be used without being discarded by separating the adhered layers of the tissue material. Hence, because the roll paper produced by this production method does not need to have a core, discarding of the core is unnecessary.

However, in the above-described method for producing coreless roll paper in the related art, in order for the inner solidified layer to serve as a core having a certain strength, the tissue material needs to be tightly wound on the winding shaft, and layers of the tissue material need to be firmly adhered and solidified. Hence, it has been difficult to separate the layers of the tissue material in the solidified inner solidified layer, and thus, it has not been easy to use up the roll paper to the end. In order to make it more easy to separate the layers of the tissue material of the inner solidified layer than in the related-art coreless roll paper, a new production method has been developed by improving the above-described production method.

In the new production method, instead of a typical winding shaft with no texture on the outer circumferential surface, a winding shaft having gear-like grooves in the outer circumferential side surface is used. When a tissue material is wound on this grooved winding shaft, the tissue material is wound so as to be stretched between the ridges of the grooves, such that the portions laminated at the positions facing the channels of the grooves are not in contact with the winding shaft. Hence, a plurality of layers of tissue material near the winding shaft side is wound such that the portions laminated at the positions facing the channels of the grooves are bent toward the axis center. In other words, the tissue material is loosely wound, compared with a case where a typical winding shaft is used.

In the layers of the loosely wound tissue material, only the portions laminated on the ridges receive a pressure from an adjoining pressure roller and are adhered together. Hence, in this new production method, the paper in the inner solidified layer is relatively loosely wound and solidified, in which only the portions laminated on the ridges are adhered, and the other portions are not adhered together. Accordingly, while the inner solidified layer maintains a certain strength that is enough to serve as a core, the layers of the tissue material can be easily separated.

CITATION LIST

Patent Literature

[PTL 1] Japanese Patent No. 4103960

SUMMARY OF INVENTION

Technical Problem

Typically, in a method for producing coreless roll paper, when the outside diameter of roll paper, which is a tissue material wound on a winding shaft and is formed into a roll shape, has reached a desired value, the winding shaft is extracted from the roll paper. Hence, when the winding shaft is extracted from the roll paper, a winding-start end is sometimes pulled out with the winding shaft, leading to deformation of the inner solidified layer.

In particular, when the above-described grooved winding shaft is used, compared with a case where a typical winding shaft is used, adhered portions of the inner solidified layer are limited, and the tissue material is loosely wound. Hence, when the winding shaft is extracted, the winding-start end is more easily pulled out, compared with a case where the typical winding shaft is used. Thus, it has been difficult to satisfy both the strength of the inner solidified layer enough to serve as a core and ease of separation of the adhered layers of the tissue material.

The present disclosure has been made to solve the problem with the related-art technique described above, and an object thereof is to provide a method for producing coreless roll paper in which it is possible to prevent deformation of roll paper when a winding shaft is extracted, more specifically, to prevent a winding-start end from being pulled out in the case where a tissue material is loosely wound, to enable stable production of coreless roll paper.

Solution to Problem

A method for producing coreless roll paper according to the present disclosure includes: a transport step in which transport means draws paper from a material roll and transports the paper; an application step in which adhesive supply means applies an adhesive to a winding-start end of the paper that is being transported; a winding step in which the paper to which the adhesive has been applied is wound on a shaft and is formed in a roll shape; and an extracting step in which the shaft is extracted from roll paper, which is the paper formed in a roll shape, to form a center hole at the center of the roll paper. The shaft includes a body part having gear-like grooves in an outer circumferential side surface thereof, and a cover member is put on and fixed to the body part. In the winding step, the paper is wound on the cover member.

In the method for producing coreless roll paper according to the present disclosure, in the extracting step, the shaft is extracted with the cover member left in the roll paper, and then the cover member is removed from the roll paper.

A method for producing coreless roll paper according to the present disclosure includes: a transport step in which transport means draws paper from a material roll and transports the paper; a winding step in which the transported paper is wound on a shaft and is formed in a roll shape; an extracting step in which the shaft is extracted from roll paper, which is the paper formed in a roll shape, to form a center hole at the center of the roll paper; and an application step in which adhesive supply means is inserted into the center hole to apply an adhesive to an inner wall portion of the center hole. The shaft includes a body part having gear-like grooves in an outer circumferential side surface thereof, and a cover member is put on and fixed to the body part. In the winding step, the paper is wound on the cover member. In the extracting step, the shaft is extracted with the cover member left in the roll paper, and then the cover member is removed from the roll paper.

In the method for producing coreless roll paper according to the present disclosure, the cover member is a flexible, non-adhesive film or sheet.

In the method for producing coreless roll paper according to the present disclosure, the cover member is tubular.

Advantageous Effects of Invention

The method for producing coreless roll paper according to the present disclosure includes: a transport step in which transport means draws paper from a material roll and transports the paper; an application step in which adhesive supply means applies an adhesive to a winding-start end of the paper that is being transported; a winding step in which the paper to which the adhesive has been applied is wound on a shaft and is formed in a roll shape; and an extracting step in which the shaft is extracted from roll paper, which is the paper formed in a roll shape, to form a center hole at the center of the roll paper. The shaft includes a body part having gear-like grooves in an outer circumferential side surface thereof, and a cover member is put on and fixed to the body part. In the winding step, the paper is wound on the cover member. Hence, when the shaft is extracted from the roll paper, it is possible to extract the shaft while protecting the center hole in the roll paper with the cover member. Accordingly, even though the paper is loosely wound on the shaft, it is possible to prevent the winding-start end of the paper from being pulled out when the shaft is extracted.

DESCRIPTION OF EMBODIMENTS

In a method for producing coreless roll paper according to the present disclosure, a shaft is extracted with a cover member left in roll paper, and then the cover member is removed from the roll paper. Hence, it is possible to reliably protect a center hole in the roll paper with the cover member when the shaft is extracted. Accordingly, because the winding-start end of the paper is not pulled out, it is possible to stably produce coreless roll paper.

The method for producing coreless roll paper according to the present disclosure includes: a transport step in which transport means draws paper from a material roll and transports the paper; a winding step in which the transported paper is wound on a shaft and is formed in a roll shape; an extracting step in which the shaft is extracted from the roll paper, which is paper formed in a roll shape, to form a center hole at the center of the roll paper; and an application step in which adhesive supply means is inserted into the center hole to apply an adhesive to an inner wall portion of the center hole. The shaft includes a body part having gear-like grooves in an outer circumferential side surface thereof, and a cover member is put on and fixed to the body part. In the winding step, paper is wound on the cover member. In the extracting step, the shaft is extracted with the cover member left in the roll paper. Then, the cover member is removed from the roll paper. Hence, by protecting the center hole in the roll paper with the cover member, it is possible to extract the shaft from the roll paper without causing deformation. Furthermore, because it is possible to directly apply the adhesive to the inner wall portion of the center hole, which is formed by extracting the shaft, only the minimum area necessary for preventing deformation of the roll paper can be adhered and solidified.

In the method for producing coreless roll paper according to the present disclosure, the cover member is made of a flexible, non-adhesive film or a sheet. Hence, it is possible to easily put the cover member on the outer circumferential side surface of the shaft. Furthermore, because it is non-adhesive, the friction caused when the shaft is extracted from the roll paper can be reduced. Moreover, when the cover member is removed from the roll paper, the cover member can be easily removed. Accordingly, compared with a case where the cover member is not a flexible, non-adhesive film or sheet, it is possible to more reliably prevent the winding-start end of the paper from being pulled out.

In the method for producing coreless roll paper according to the present disclosure, the cover member is tubular. Hence, it is possible to easily fix the cover member to the outer circumferential side surface of the shaft.

Embodiments of the present disclosure will be described below.

First Embodiment

Figure 1:
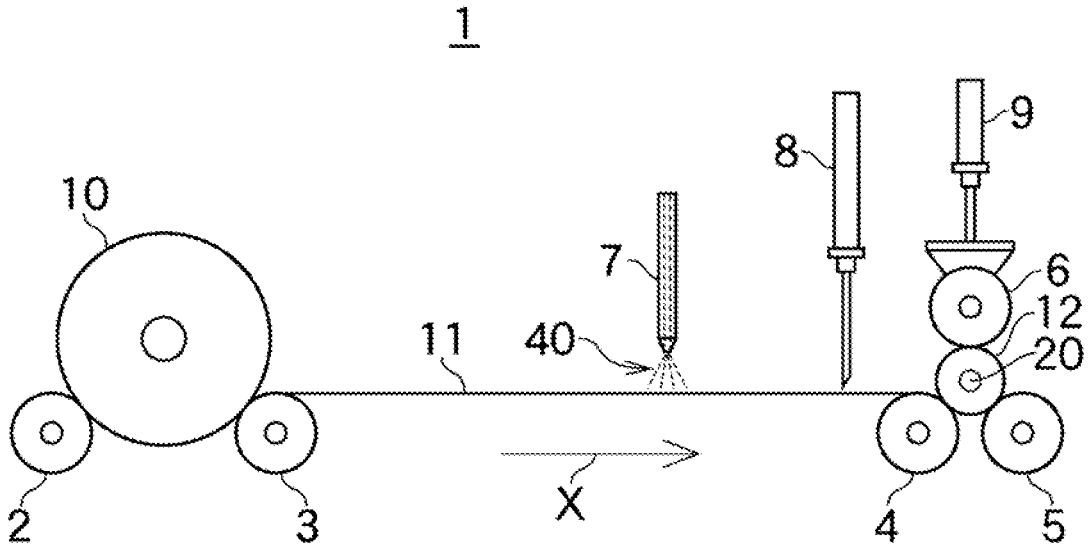
FIG. 1 is an explanatory diagram showing a schematic structure of a production apparatus for performing a method for producing coreless roll paper according to a first embodiment of the present disclosure.
Figure 2:
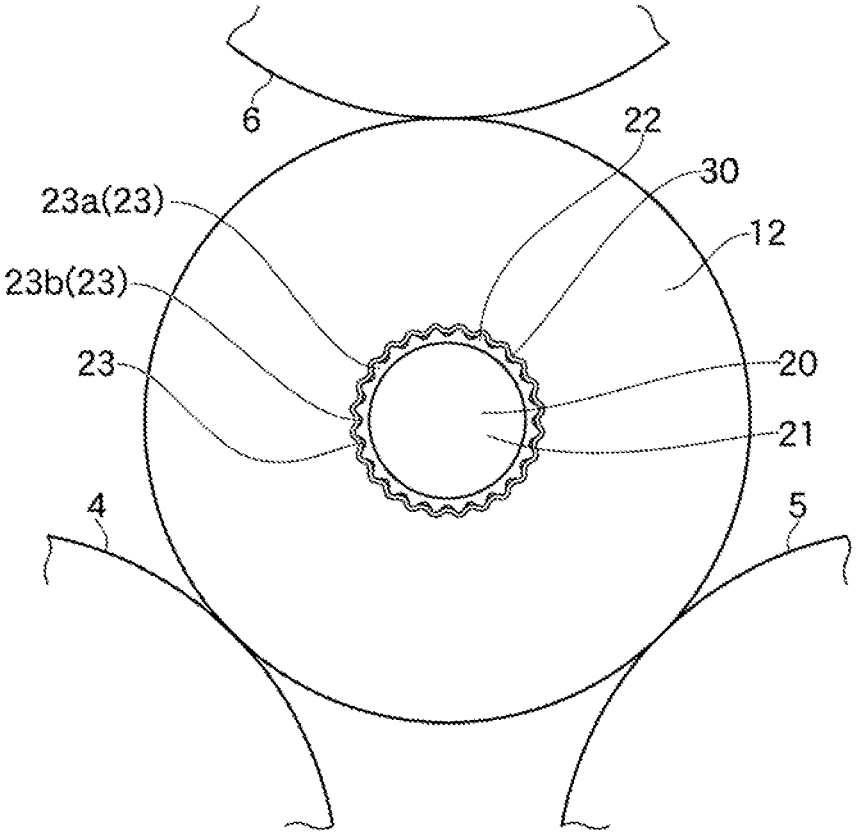
FIG. 2 is an enlarged view showing a shaft and the vicinity thereof in the production apparatus for performing the method for producing coreless roll paper according to the first embodiment of the present disclosure.

FIG. 1 is an explanatory diagram showing a schematic structure of a production apparatus 1 for performing a method for producing coreless roll paper according to a first embodiment of the present disclosure, and shows the arrangement configuration of the respective components of the apparatus when the production apparatus 1 is viewed from a side. FIG. 2 is an enlarged view showing a shaft 20, serving as a winding shaft in the production apparatus 1, and the vicinity thereof, as viewed from a side.

As shown in FIG. 1, in the production apparatus 1, a material roll 10 is disposed at a predetermined position, and the production apparatus 1 includes feed rollers 2 and 3, serving as transport means, arranged so as to be in contact with the outer circumference of the material roll 10. The feed rollers 2 and 3 draw paper 11 from the material roll 10 and transport the paper toward the shaft 20 (in the transport direction shown by arrow X in FIG. 1). The paper 11 drawn from the material roll 10 is transported also by a guide and rollers (not shown), besides the feed rollers 2 and 3.

The production apparatus 1 also includes an adhesive supplier 7 serving as adhesive supply means, and a cutter 8, at a position above the transported paper 11 and between the material roll 10 and the shaft 20. The adhesive supplier 7 and the cutter 8 are disposed at a position immediately before the position where the paper 11 transported by the feed rollers 2 and 3 is wound on the shaft 20 (i.e., near the shaft 20).

The production apparatus 1 also includes winding auxiliary rollers 4 and 5 and a pressure roller 6 in the vicinity of the shaft 20. The winding auxiliary rollers 4 and 5 and the pressure roller 6 are arranged so as to allow the transported paper 11 to be wound on the shaft 20.

The pressure roller 6 is arranged above the shaft 20 and presses, from above, the paper 11 wound on the shaft 20. Hence, the paper 11 is wound under a predetermined tension, while being pressed by the pressure roller 6. The pressure roller 6 is supported by support means 9 or the like so as to be movable in the top-bottom direction. Thus, the pressing force thereof is adjusted according to the outside diameter of a roll paper 12, which is the paper 11 wound on the shaft 20 and is formed in a roll shape (FIG. 2 shows the position relationship among the winding auxiliary rollers 4 and 5, the pressure roller 6, and the roll paper 12).

The adhesive supplier 7 is disposed above the transported paper 11 (see FIG. 1). The adhesive supplier 7 applies an adhesive 40 to the surface of the transported paper 11, by jetting or dropping, as droplets, the adhesive 40 from above. The adhesive 40 hardens and solidifies the laminated paper 11 when dried.

Furthermore, the amount of the adhesive 40 to be applied by the adhesive supplier 7 and the area thereof are controlled by control means or the like (not shown). More than one adhesive supplier 7 may be arranged in a straight line between the ends of the paper 11 in the width direction. Although FIG. 1 shows, for the purpose of explaining the adhesive supplier 7, a state in which the adhesive 40 is being applied, in actuality, the adhesive 40 is applied only to the winding-start end (not shown) of the paper 11.

Similarly to the adhesive supplier 7, the cutter 8 is disposed above the paper 11 (see FIG. 1). The cutter 8 cuts the paper 11 that is drawn toward the shaft 20. More specifically, when the outside diameter of the roll paper 12 has reached a desired value, the cutter 8 is driven to cut the paper 11. The driving of the cutter 8 is controlled by control means or the like (not shown).

Although a configuration in which the material roll 10 is disposed at a predetermined position, and the paper 11 is fed from the material roll 10 and is wound on the shaft 20 is shown in this embodiment, a configuration is also possible in which a paper making machine including a wire part, a press part, a dryer part, and the like is provided instead of the material roll 10, the feed rollers 2 and 3, and the like, and the paper 11 produced by this paper making machine is transported to the shaft 20 and the like by the transport means.

Figure 3:
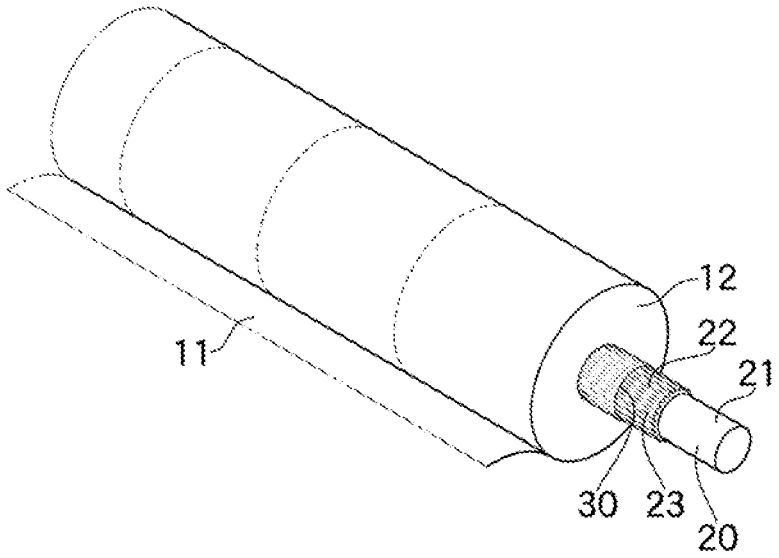
FIG. 3 is a perspective view showing an end of the shaft in the production apparatus for performing the method for producing coreless roll paper according to the first embodiment of the present disclosure.
Figure 4:
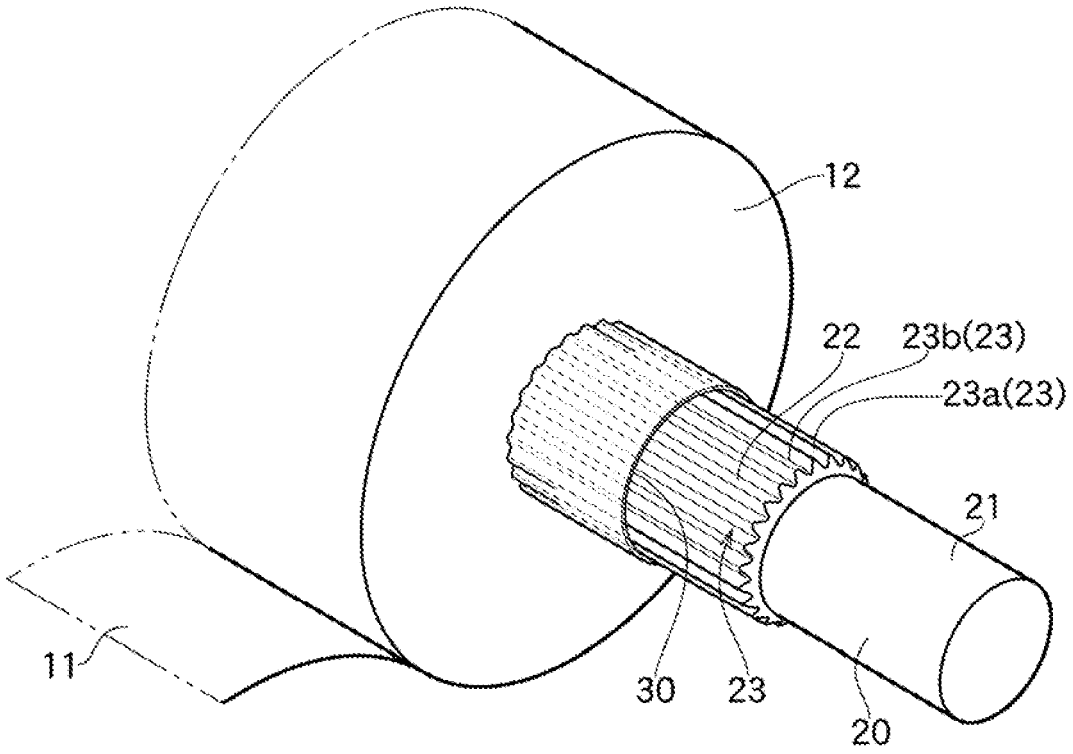
FIG. 4 is an enlarged view showing the end of the shaft of the production apparatus for performing the method for producing coreless roll paper according to the first embodiment of the present disclosure.

FIG. 3 is a perspective view showing an end of the shaft 20 in the production apparatus 1. FIG. 4 is an enlarged view showing the end of the shaft 20. In FIG. 3, the illustration of the winding auxiliary rollers 4 and 5, the pressure roller 6, and the like, shown in FIG. 1, is omitted.

The shaft 20 is a cylindrical shaft member, and the paper 11 is wound on the outer circumferential side surface of a body part 22 at the center. In the shaft 20, the outside diameter of ends 21 of the shaft 20 is smaller than the outside diameter of the body part 22 (see FIG. 3), and the ends 21 are rotatably and removably engaged with engaging portions (not shown) of the production apparatus 1.

Furthermore, as shown in FIG. 4, the shaft 20 has grooves 23 formed by cutting straight grooves, extending from one end to the other end of the body part 22, in the outer circumferential side surface of the body part 22. More specifically, a plurality of grooves 23 is successively formed in the circumference of the body part 22. Due to the successive grooves 23, the outer circumferential side surface of the body part 22 has a gear-like structure. In other words, the outer circumferential side surface of the body part 22 has a plurality of ridges **23*a* and channels 23*b*** arranged alternately in the circumference.

Furthermore, a sleeve 30, serving as a cover member, is fixed to the shaft 20 so as to cover the grooves 23 in the circumference of the body part 22 (see FIG. 2). The sleeve 30 is formed of a flexible, non-adhesive film or sheet and is formed in a cylindrical shape. The sleeve 30 is fixed in a state in which the shaft 20 passes therethrough and the sleeve 30 is put on the body part 22. The sleeve 30 is formed such that the inside diameter thereof is slightly larger than the outside diameter of the body part 22 and thus can be fixed simply by putting it on the body part 22.

The sleeve 30 is put on the shaft 20 so as to be stretched from a ridge **23*a* to an adjoining ridge 23*a* of the grooves 23. Hence, portions of the sleeve 30 opposed to the channels 23*b* are fixed so as to be slightly bent toward the axis center of the shaft 20 (see FIG. 2**).

Various films or sheets may be used for the sleeve 30. For example, a film or a sheet that is made of a synthetic resin, such as polyethylene, polypropylene, polyvinyl chloride, or polystyrene, may be used, and the thickness thereof is, for example, from 10 μm to 1 mm. It is desirable that the sleeve 30 be made of a film or a sheet that is made of polyethylene or polypropylene, from the standpoint that it has flexibility, non-adhesiveness, and the property in which it is not easily adhered by a typical adhesive.

Although a configuration in which the cover member is the cylindrical sleeve 30 that can be fixed to the body part 22 simply by putting it thereon has been described in this embodiment, a configuration is also possible in which, for example, the cover member is formed of a rectangular film or sheet, and the film or sheet is wrapped around the body part 22 and is fixed with fastening means (not shown), such as adhesive tape or the like.

Next, the operation of the production apparatus 1 will be described.

Figure 5:
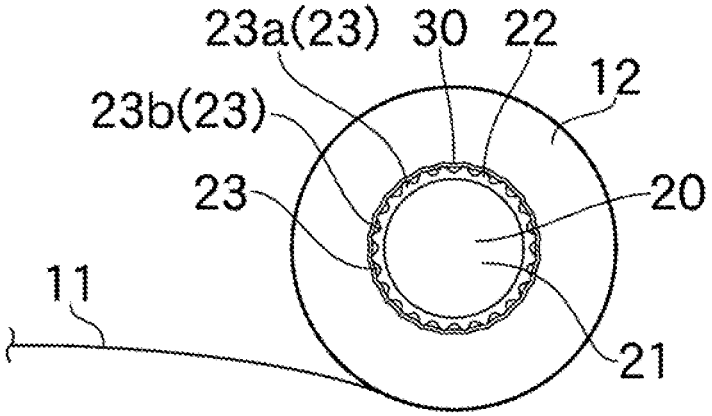
FIG. 5 is a first explanatory diagram showing transition of the roll paper produced by the method for producing coreless roll paper according to the first embodiment of the present disclosure.
Figure 6:
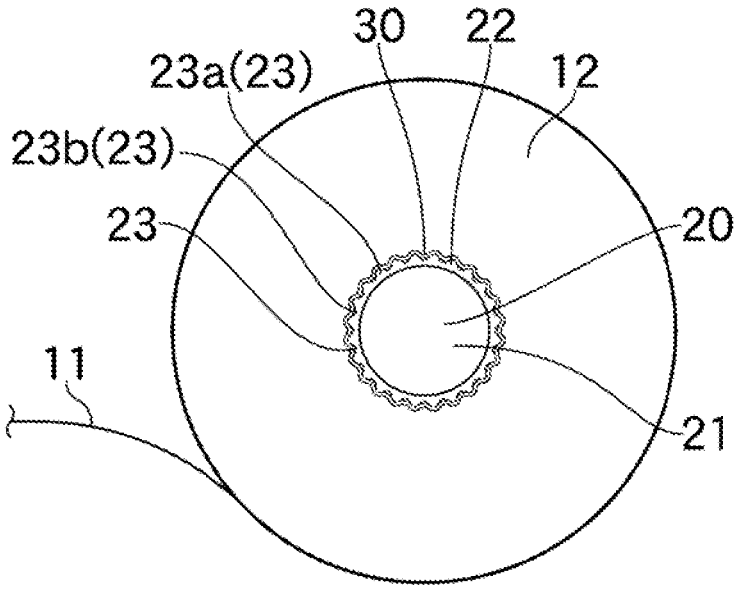
FIG. 6 is a second explanatory diagram showing transition of the roll paper produced by the method for producing coreless roll paper according to the first embodiment of the present disclosure.
Figure 7:
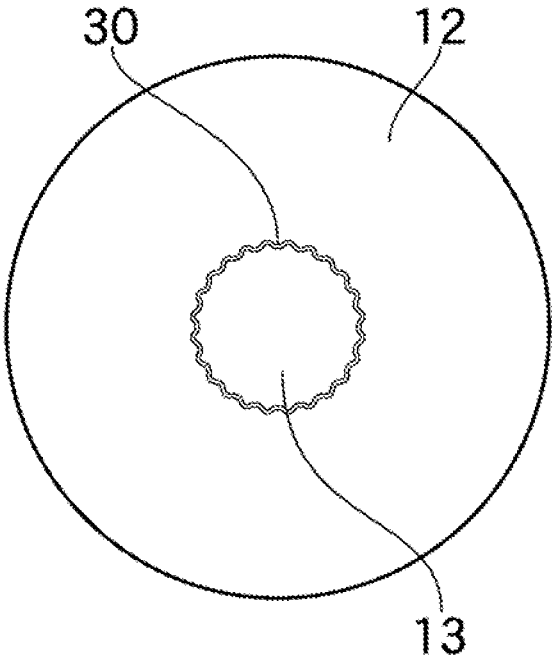
FIG. 7 is a third explanatory diagram showing transition of the roll paper produced by the method for producing coreless roll paper according to the first embodiment of the present disclosure.
Figure 8:
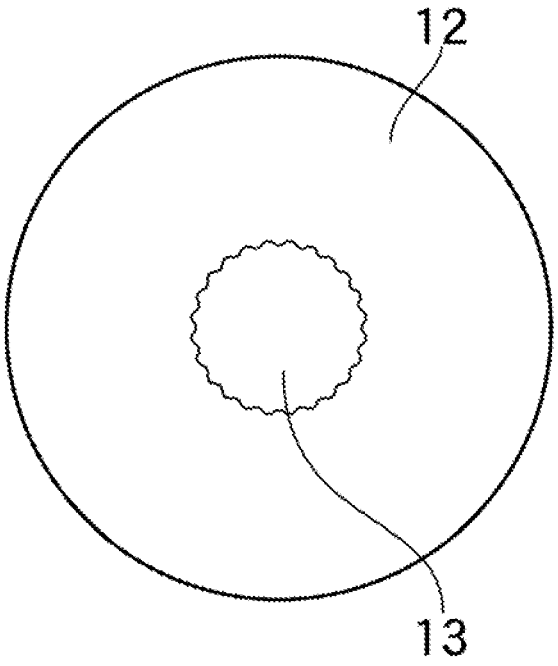
FIG. 8 is a fourth explanatory diagram showing transition of the roll paper produced by the method for producing coreless roll paper according to the first embodiment of the present disclosure.

FIGS. 5, 6, 7, and 8 are explanatory diagrams showing transitions of the roll paper 12 produced with the production apparatus 1. FIG. 5 shows a state in which the paper 11 is wound to form the roll paper 12, and FIG. 6 shows a state in which the outside diameter of the roll paper 12 has reached a desired value. Furthermore, FIG. 7 shows the roll paper 12 after the shaft 20 has been extracted, and FIG. 8 shows the roll paper 12 after the sleeve 30 has been removed from a center hole 13.

(Transport Step)

In the production apparatus 1, the feed rollers 2 and 3, as shown in FIG. 1, are rotationally driven to rotate the material roll 10, which is in contact with the feed rollers 2 and 3 at the outer circumference thereof. As a result, the paper 11 is drawn from the material roll 10 and is transported at a predetermined speed. The paper 11 drawn from the material roll 10 is transported toward the shaft 20 (in the transport direction, shown by arrow X in FIG. 1) at the above-described predetermined speed by a guide and rollers.

(Application Step)

Subsequently, the adhesive supplier 7 applies the adhesive 40 to the winding-start end of the transported paper 11. Herein, the winding-start end is a portion corresponding to a plurality of layers of the paper 11 to be initially wound on the shaft 20 and is a portion having a length corresponding to, for example, five to twenty turns around the shaft 20 after the end of the paper 11 starts to be wound on the shaft 20. Hence, in the production apparatus 1, the application of the adhesive 40 is started when the end of the paper 11 is transported below the adhesive supplier 7, and the application of the adhesive 40 is stopped when the paper 11 is wound five to twenty turns around the shaft 20.

(Winding Step)

Subsequently, after the adhesive 40 is applied, the paper 11 reaching the shaft 20 is nipped between the shaft 20 and the winding auxiliary roller 4 and then between the shaft 20 and the winding auxiliary roller 5 and, consequently, is wound on the circumference of the shaft 20. In other words, the paper 11 passes on the upper-end side of the winding auxiliary rollers 4 and 5 and is wound on the shaft 20 such that the side to which the adhesive 40 has been applied is located on the inner side of the roll.

Furthermore, in the winding step, the sleeve 30 has been fixed so as to be put on the circumference of the shaft 20, more specifically, the grooves 23 in the body part 22 (see FIGS. 5 and 6). Hence, the paper 11 is not directly wound on the shaft 20, but is wound on the shaft 20 with the sleeve 30 therebetween (see FIG. 5).

The paper 11 wound on the shaft 20 and formed in a roll shape is laminated on the sleeve 30 while being pressed by the pressure roller 6. By being pressed by the pressure roller 6, the paper 11 is wound without creases and in the form of a perfect circle around the shaft 20, serving as the axis.

Although a configuration in which the side to which the adhesive 40 is applied is located on the inner side of the roll has been described in this embodiment, a configuration is also possible in which the end of the paper 11 is folded back when the paper 11 starts to be wound, so that the side to which the adhesive 40 is applied is not in contact with the surface of the sleeve 30.

Then, when the outside diameter of the paper 11 wound on the shaft 20 and formed in a roll shape, that is, the roll paper 12, has reached a predetermined value (see FIG. 6), feeding of the paper 11 from the material roll 10 is stopped, and the paper 11 is cut with the cutter 8. It is possible to configure such that application means or the like (not shown) applies an adhesive or moisture to the cut end of the paper 11 (the terminal end of the paper 11 wound on the shaft 20), so that the terminal end is fixed to the outer circumferential surface of the roll paper 12.

(Extracting Step)

Subsequently, the shaft 20 is removed from the engaging portions of the production apparatus 1, and the roll paper 12 is transferred to a support base (not shown). Then, the shaft 20 is extracted from the roll paper 12 fixed to the support base. Herein, when the shaft 20 is extracted from the roll paper 12, only the shaft 20 is extracted such that the sleeve 30 is left in the roll paper 12. By doing so, the center hole 13, which remains after the shaft 20 is extracted, is formed in the center of the roll paper 12, and the sleeve 30 is left in the inner wall portion of the center hole 13 (see FIG. 7). The center hole 13 is formed as a through-hole extending along the axis of the roll paper 12, and a texture pattern corresponding to the grooves 23 is formed on the inner wall portion (see FIGS. 7 and 8).

Next, the sleeve 30 is removed from the inner wall portion of the center hole 13 (see FIG. 8). For example, the sleeve 30 may be perforated in advance, so that the sleeve 30 can be torn in two by pulling the longitudinal ends of the sleeve 30 in opposite directions. With this configuration, by pulling the ends of the sleeve 30 from the ends of the center hole 13, the sleeve 30 is torn at the perforated line and can be easily removed.

In this embodiment, although a configuration in which the sleeve 30 is removed from the center hole 13 after the shaft 20 is extracted has been described, for example, a configuration is also possible in which the body part 22 of the shaft 20 has a variable outside diameter, the outside diameter of the body part 22 is reduced after the paper 11 is wound, and the sleeve 30 is removed at the same time when the shaft 20 is extracted.

Furthermore, in this embodiment, although a configuration in which the paper 11 is wound on the single shaft 20 has been described, for example, a configuration is also possible in which a plurality of shafts 20 is provided, and the paper 11 is successively wound thereon. In that case, although a configuration in which the paper 11 is cut with the cutter 8 when the roll paper 12 has reached a predetermined outside diameter has been described in this embodiment, for example, a configuration in which a next shaft 20 is supplied from above the paper 11, at a position between the adhesive supplier 7 and the cutter 8, before the paper 11 is cut is desirable.

More specifically, when the paper 11 is cut, one end is wound on the roll paper 12, and the other end is wound on the next shaft 20. Hence, the adhesive supplier 7 preliminarily applies the adhesive 40 to the ends and the vicinity thereof, and the next shaft 20 is supplied so as to be lightly pressed against this portion. By doing so, it is possible to cut the paper 11 in a state in which the portion serving as the end of the paper 11 is temporarily adhered to the sleeve 30 of the next shaft 20. When the cutter 8 performs cutting, for example, an air jetting device (not shown) may be provided below the cutter 8 to jet air from below to prevent the temporarily adhered paper from peeling off.

After the paper 11 is cut, the next shaft 20 to which the end of the paper 11 is temporarily adhered is moved to the position above the winding auxiliary rollers 4 and 5 in accordance with the restart of the transportation of the paper 11. Thereafter, the paper 11 is wound as in the normal winding step. By performing the extracting step on the roll paper 12 located on the winding auxiliary rollers 4 and 5 simultaneously with the movement of the next shaft 20, the next shaft 20 can be successively supplied to the position above the winding auxiliary rollers 4 and 5 in accordance with the transfer of the roll paper 12 to the support base. This way, it is possible to successively wind the paper 11 on the shaft 20.

The method for producing coreless roll paper according to this embodiment is configured as above. With this production method, when the shaft 20 is extracted from the roll paper 12, it is possible to extract the shaft 20 from the roll paper 12 while reliably protecting the center hole 13 in the roll paper 12 with the sleeve 30. Accordingly, even though the paper 11 is loosely wound on the shaft 20, it is possible to prevent the winding-start end of the paper 11 from being pulled out when the shaft 20 is extracted, and thus, it is possible to stably produce the coreless roll paper 12.

Second Embodiment

Next, a method for producing coreless roll paper according to a second embodiment of the present disclosure will be described.

Figure 9:
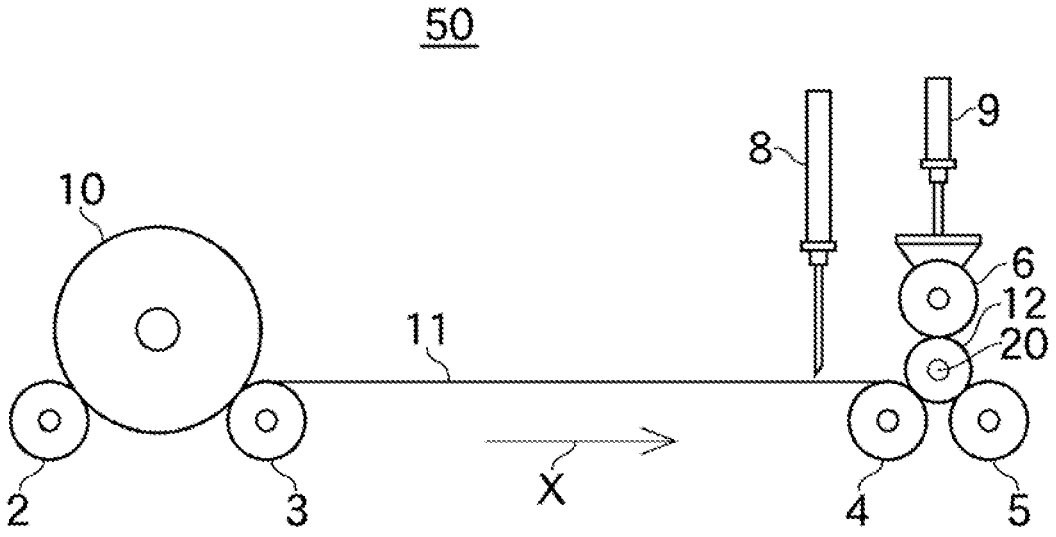
FIG. 9 is an explanatory diagram showing a schematic structure of a production apparatus for performing a method for producing coreless roll paper according to a second embodiment of the present disclosure.
Figure 10:
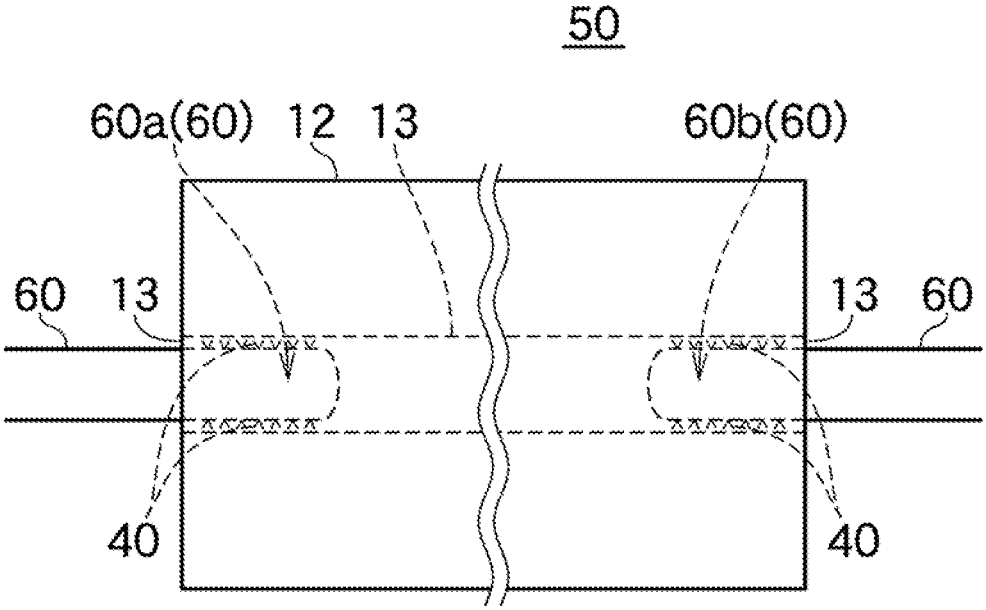
FIG. 10 is an explanatory diagram showing adhesive supply means in the production apparatus for performing the method for producing coreless roll paper according to the second embodiment of the present disclosure.

FIG. 9 is an explanatory diagram showing a schematic structure of a production apparatus 50 for performing a method for producing coreless roll paper according to the second embodiment of the present disclosure. FIG. 10 is an explanatory diagram showing adhesive suppliers 60 of the production apparatus 50. The configurations that are the same as those of the production apparatus 1 will be denoted by the same reference signs, and detailed descriptions thereof will be omitted. The configurations different from those in the production apparatus 1 will be mainly described.

As shown in FIG. 9, in the production apparatus 50, the material roll 10 is disposed at a predetermined position, and the production apparatus 50 includes the feed rollers 2 and 3 arranged so as to be in contact with the outer circumference of the material roll 10, the winding auxiliary rollers 4 and 5 and the pressure roller 6 arranged near the shaft 20, and the cutter 8 arranged near the shaft 20. This configuration is the same as that of the production apparatus 1.

As shown in FIG. 10, the production apparatus 50 includes a pair of adhesive suppliers 60 opposed to each other, instead of the adhesive supplier 7 of the production apparatus 1. The adhesive suppliers 60 are a pair of tubular members with sealed ends and are inserted into the center hole 13 remaining after the shaft 20 is extracted from the roll paper 12 and then the sleeve 30 is removed.

More specifically, the movement of insertion ends 60*a* and 60*b* of the adhesive suppliers 60 is controlled by control means and the like (not shown), and the insertion ends 60*a* and 60*b* are inserted from the ends of the center hole 13 (see FIG. 10). Furthermore, the insertion ends 60*a* and 60*b* have a plurality of jetting holes (not shown) in the circumferences thereof, through which the adhesive 40 is jetted by delivery means, such as a pump or the like (not shown). The amount and area of the adhesive 40 jetted from the jetting holes in the insertion ends 60*a* and 60*b* are controlled by the delivery means.

Next, the operation of the production apparatus 50 will be described.

The operation in the application step, which is different from that in the production method according to the first embodiment, will be mainly described. Furthermore, in the method for producing coreless roll paper according to the second embodiment, because the application step is performed after the extracting step, the paper 11 is wound on the shaft 20 without the adhesive 40.

(Application Step)

In the roll paper 12 after the shaft 20 is extracted in the extracting step and then the sleeve 30 is removed, the insertion ends 60*a* and 60*b* of the adhesive suppliers 60 are inserted from the ends of the center hole 13. Then, the insertion ends 60*a* and 60*b* inserted into the center hole 13 jets the adhesive 40 onto the inner wall portion of the center hole 13 through the jetting holes (see FIG. 10). With this configuration, it is possible to apply an appropriate amount of the adhesive 40 only to the minimum area of the inner wall portion of the center hole 13 that needs to be adhered and solidified.

The method for producing coreless roll paper according to this embodiment is configured as above. With this production method, even though the roll paper 12 is wound without the adhesive 40, it is possible to extract the shaft 20 from the roll paper 12 without causing deformation by protecting the center hole 13 with the sleeve 30. Moreover, because it is possible to directly jet the adhesive 40 to the inner wall portion of the center hole 13 remaining after the shaft 20 is extracted and the sleeve 30 is removed, only the minimum area necessary for preventing deformation of the roll paper 12 can be adhered and solidified. Accordingly, because the portion solidified with the adhesive 40 is small, the coreless roll paper 12 can be easily used up to the end.

Although a configuration in which the paper 11 is wound without the adhesive 40 has been described in this embodiment, a configuration is also possible in which, in order to prevent the paper 11 from being unwound when it is wound on the shaft 20, the paper 11 is wound on the shaft 20 in a temporarily adhered state by jetting water onto the winding-start end of the paper 11.

Although the embodiments of the present disclosure have been described in detail above, the present disclosure is not limited to the above-described embodiments, and various design changes may be made as long as such changes do not depart from the claims.

REFERENCE SIGNS LIST

1 production apparatus
2, 3 feed roller
4, 5 winding auxiliary roller
6 pressure roller
7 adhesive supplier
8 cutter
9 support means
10 material roll
11 paper
12 roll paper
13 center hole
20 shaft
21 end
22 body part
23 groove
23*a* ridge
23*b* channel
30 sleeve (cover member)
40 adhesive
50 production apparatus
60 adhesive supplier
60*a*, 60*b* insertion end X transport direction

The invention claimed is:

1. A method for producing coreless roll paper, the method comprising:

a transport step in which transport means draws paper from a material roll and transports the paper;

an application step in which adhesive supply means applies an adhesive to a winding-start end of the paper that is being transported;

a winding step in which the paper to which the adhesive has been applied is wound on a shaft of a production apparatus and is formed in a roll shape; and an extracting step in which the shaft is extracted from roll paper, which is the paper formed in a roll shape, to form a center hole at the center of the roll paper, wherein the shaft includes a body part having gear-like grooves in an outer circumferential side surface thereof, and a cover member is put on and fixed to the body part, in the winding step, the paper is wound on the cover member, and the cover member is a sleeve.

2. The method for producing coreless roll paper according to claim 1, wherein, in the extracting step, the shaft is extracted with the cover member left in the roll paper, and then the cover member is removed from the roll paper.

3. The method for producing coreless roll paper according to claim 2, wherein the cover member is a flexible, non-adhesive film or sheet.

4. The method for producing coreless roll paper according to claim 3, wherein the cover member is tubular.

5. The method for producing coreless roll paper according to claim 2, wherein the cover member is tubular.

6. The method for producing coreless roll paper according to claim 1, wherein the cover member is a flexible, non-adhesive film or sheet.

7. The method for producing coreless roll paper according to claim 6, wherein the cover member is tubular.

8. The method for producing coreless roll paper according to claim 1, wherein the cover member is tubular.

9. The method for producing coreless roll paper according to claim 1, wherein the cover member is made from polyethylene, polypropylene, polyvinyl chloride, or polystyrene.

10. A method for producing coreless roll paper, the method comprising:

a transport step in which transport means draws paper from a material roll and transports the paper;

a winding step in which the transported paper is wound on a shaft of a production apparatus and is formed in a roll shape;

an extracting step in which the shaft is extracted from roll paper, which is the paper formed in a roll shape, to form a center hole at the center of the roll paper; and an application step in which adhesive supply means is inserted into the center hole to apply an adhesive to an inner wall portion of the center hole, wherein the shaft includes a body part having gear-like grooves in an outer circumferential side surface thereof, and a cover member is put on and fixed to the body part, in the winding step, the paper is wound on the cover member, in the extracting step, the shaft is extracted with the cover member left in the roll paper, and then the cover member is removed from the roll paper, and the cover member is a sleeve.

11. The method for producing coreless roll paper according to claim 10, wherein the cover member is a flexible, non-adhesive film or sheet.

12. The method for producing coreless roll paper according to claim 11, wherein the cover member is tubular.

13. The method for producing coreless roll paper according to claim 10, wherein the cover member is tubular.

14. The method for producing coreless roll paper according to claim 10, wherein the cover member is made from polyethylene, polypropylene, polyvinyl chloride, or polystyrene.

* * * * *